United States Patent [19]

Zimmer, Sr.

[11] 4,327,671

[45] May 4, 1982

[54] REMOVABLE FLUE BAFFLES

[75] Inventor: Jon W. Zimmer, Sr., Elmhurst, Ill.

[73] Assignee: Gas Research Institute, Chicago, Ill.

[21] Appl. No.: 176,020

[22] Filed: Aug. 7, 1980

[51] Int. Cl.[3] ..... F22B 9/00

[52] U.S. Cl. ..... 122/44 A; 110/326; 122/155 A; 138/38

[58] Field of Search ..... 122/155 A, 44 A; 138/38; 126/364-365; 110/326, 322; 165/184, 181-183

[56] References Cited

U.S. PATENT DOCUMENTS

| | | | |
|---|---|---|---|
| 1,120,550 | 12/1914 | Schulz | 122/44 A |
| 2,067,133 | 1/1937 | Wales | 122/155 A |
| 2,116,298 | 5/1938 | Ball et al. | 122/55 A |
| 2,266,551 | 12/1941 | Harvey | 122/155 A |
| 3,783,938 | 1/1974 | Chartet | 138/38 X |
| 4,090,559 | 5/1978 | Megerlin | 138/38 X |

*Primary Examiner*—Edward G. Favors

*Attorney, Agent, or Firm*—Thomas W. Speckman

[57] ABSTRACT

A flue baffle may be removed from the narrow end of a frusto-conical flue. The baffle has a plurality of hinged plates secured to a tube, and slots in the tube beneath each plate. A slidable rod extends through the tube and has a plurality of pins which extend through the slots and contact the plates. When the rod slides down, the pins also descend, and the plates collapse. When the rod is lifted upwardly, the pins push the plates apart. A dowel may be secured to the tube to communicate with the rod to secure the rod in relation to the tube and spread the plates at a pre-determined point. The width of the plates is smaller than the narrow end of the flue so that the baffle may be removed when the plates are collapsed. The plates may be skewed on the tube so that all of the gases and heat which rise through the flue are diverted toward the flue wall by at least one of the plates without excessively obstructing the flow of gases out of the flue.

24 Claims, 4 Drawing Figures

Fig. 1.
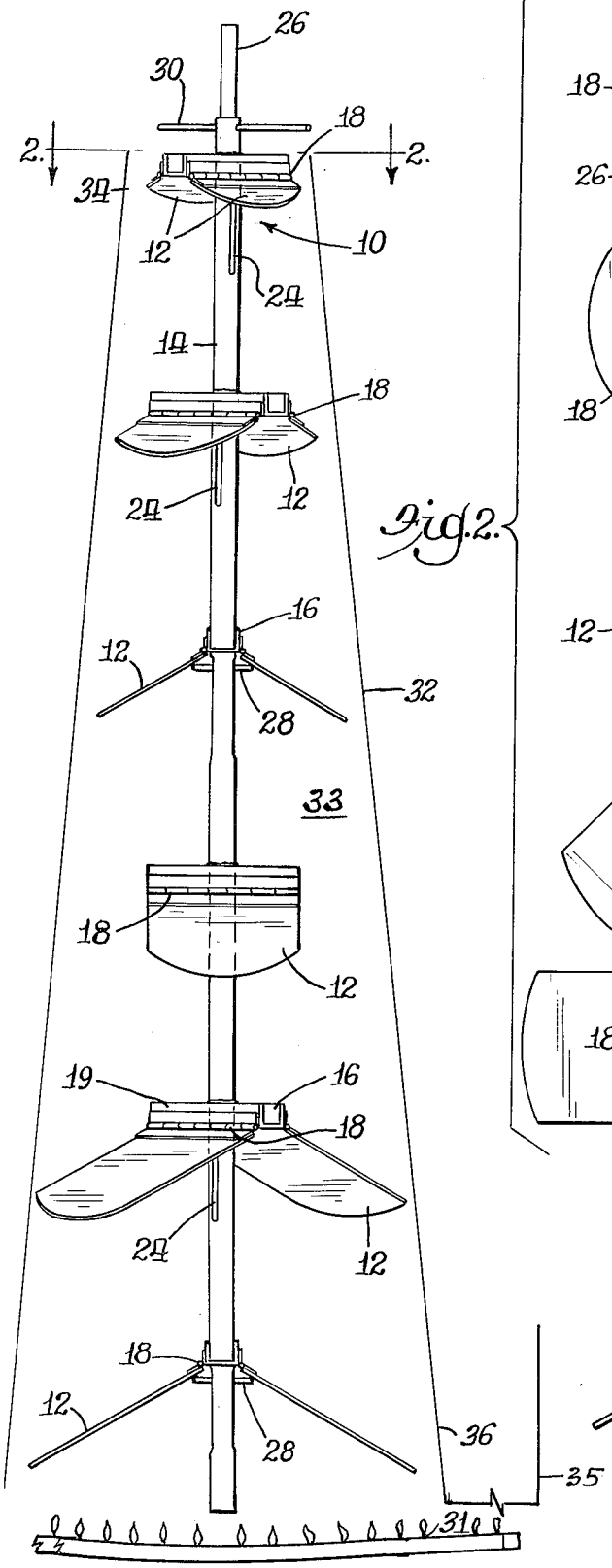
Fig. 2.
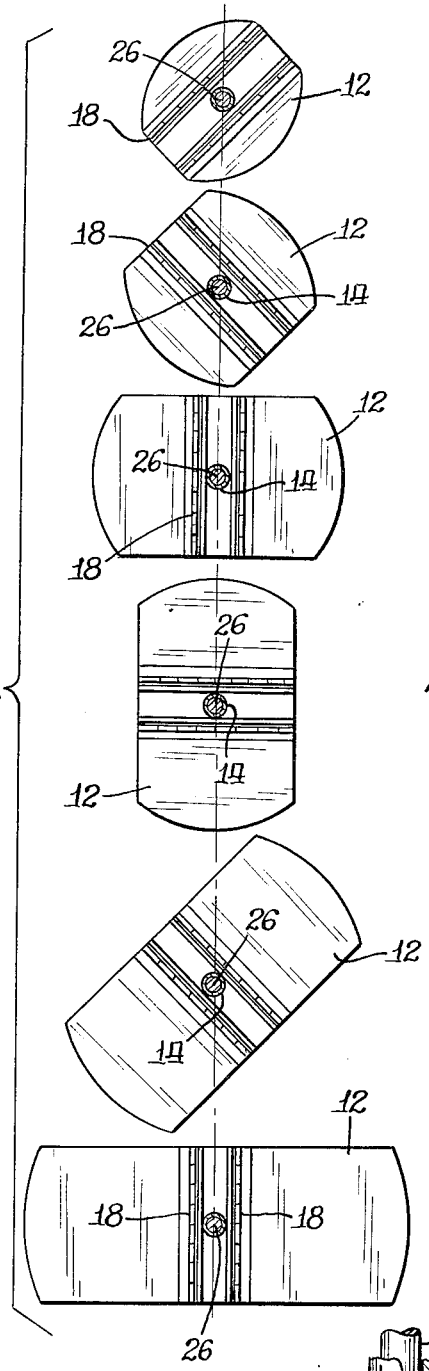
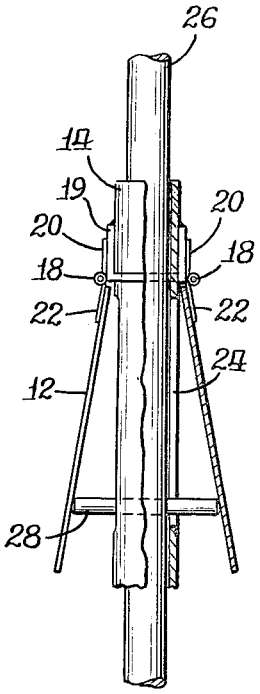
Fig. 3.
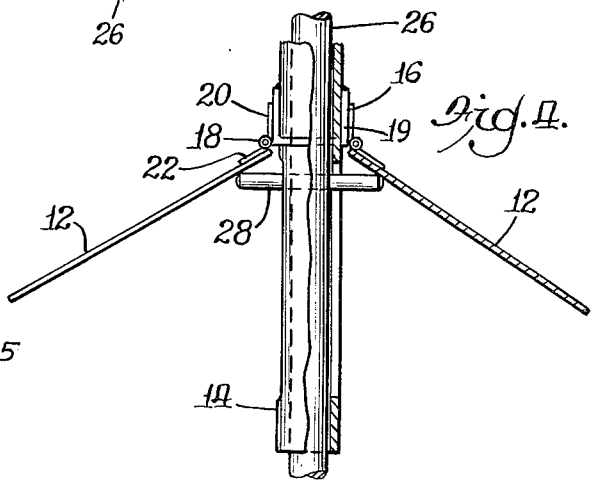
Fig. 4.

REMOVABLE FLUE BAFFLES

BACKGROUND OF THE INVENTION

This invention relates to flue baffles, and more particularly to flue baffles which may be removed from the small end of frusto-conical flues.

Water heating devices and the like often have a heat source, such as a gas burner, under a water storage tank. Exhaust gases and much of the heat created during combustion leave the heating device through a flue which extends through the center of the storage tank. Water in the storage tank is heated primarily in the bottom of the tank by the burner, and secondarily by the heat in the flue.

The efficiency of the heater may be improved by increasing heat transfer from the flue gas to the water. One way to increase efficiency is to use an upright frusto-conical flue having a large end near the burner and a small end near the top of the flue. Such a shape of the flue itself forces more of the flue gas heat against the walls of the flue as it rises. Efficiency may also be increased by adding a turbulator or a baffle to the inside of the flue. The turbulator or baffle may be any suitable form which directs heat towards the walls of the flue without excessively obstructing the flow of exhaust gases out of the heating device. Turbulating devices are described in U.S. Pat. Nos. 4,044,796 and 3,759,230.

Baffles may be used to direct heat toward the walls of the flue in heating devices which have straight or frusto-conical flues. Baffles for straight flues are described in U.S. Pat. Nos. 62,953, 257,139, 598,997, 753,900, 1,536,613, 1,677,630, 2,116,298 and 2,369,995. Baffles for other shapes of flues may be seen in U.S. Pat. Nos. 277,567, 1,101,872, and for a frusto-conical flue in U.S. Pat. No. 1,640,284.

If an upright frusto-conical flue is used in a heating device, and any of the baffle plates are larger than the small end of the flue, then the baffle must be installed in the flue from the large flue end, and it may not be removed without disassembling virtually the entire heating device. This will make the cleaning or repairing of the heating device much more difficult. Thus, there is a need for baffles which may be installed in and removed from frusto-conical flues through the small end of the flue.

Accordingly, an object of the present invention is to provide new and improved baffles for flues.

Another object is to provide new and improved baffles which may be installed in and removed from frusto-conical flues through the small end of the flue.

SUMMARY OF THE INVENTION

In keeping with one aspect of this invention, a baffle has a hollow tube with a plurality of hinged plates secured to the tube and a slot in the tube beneath each plate. A slidable rod in the center of the tube has pins which extend through the slots, and means for raising or lowering the rod in the tube. When the rod is raised, the pins raise the plates away from the tube. When the rod is lowered, the pins are also lowered, and the plates collapse. The baffle may be installed in or removed from the small end of a frusto-conical flue when the plates are collapsed. The plates may be long enough to extend to the flue wall when raised but are no wider than the small end of the flue. A plurality of plates may be secured to the tube, if desired, and the plates may be skewed at different radial angles on the rod to increase the turbulence of flue gas in the flue.

BRIEF DESCRIPTION OF THE DRAWINGS

The above mentioned and other features of this invention and the manner of obtaining them will become more apparent, and the invention itself will be best understood by reference to the following description of an embodiment of the invention taken in conjunction with the accompanying drawings wherein:

FIG. 1 is a side view of a baffle according to one embodiment of this invention, including a schematic view of a frusto-conical flue and burner;

FIG. 2 is a series of plan views of the plates of the baffle of FIG. 1, taken along lines 2—2 of FIG. 1;

FIG. 3 is a partial side cutaway view of a portion of the baffle of FIG. 1 with the plates collapsed; and FIG. 4 is a partial side cutaway view of a portion of the baffle of FIG. 1, with the plates spread.

DESCRIPTION OF THE PREFERRED EMBODIMENTS

A baffle 10 (FIG. 1) has a plurality of plates 12 secured to a tube 14 by bars 16 and hinges 18. Each bar 16 may be generally U-shaped, and a hinge 18 may be secured to each side 19 of the bar 16. A first side 20 of hinge 18 may be secured to side 19 by any suitable means, and a second side 22 of hinge 18 may be secured to a plate 12 by any suitable means, such as spot welding. The hinge 18 allows the plate 12 to be raised and collapsed freely.

A plurality of slots 24 are provided in tube 14 beneath each side 19 of the bars 16 which carries hinges 18 and plates 12. Each slot 24 is generally beneath its adjacent side 19.

A rod 26 extends through the center of tube 14, and slides inside the tube. Pins 28 in rod 26 extend through the slots 24 in tube 14, and contact the bottom of plates 12. The rod 26 may slide downward sufficiently far for the plates 12, which rest on the pins 28, to collapse to the position shown in FIG. 3.

Rod 26 may be raised to any predetermined point. As the rod 26 travels up, the pins 28 spread the plates 12 as shown in FIG. 4. A dowel 30 extends through rod 26 to hold the rod 26 in place at a predetermined point by resting on top of or through a hole in tube 14. The plates 12 are preferably in a conical relationship to each other when dowel 30 is in place.

The baffle 10 may be installed in a heating device having a burner 31 (FIG. 1), a frusto-conical flue 33 through which exhaust gases and heat created by the burner 31 are released, and a storage tank 35 which surrounds the flue wall 32. The storage tank may contain water, oil or any other liquid which is to be heated. The baffle 10 may also be installed in a heat recuperator which has a flue 33, a heat source beneath the flue 32, and a medium adjacent the outside of the flue wall 32 which is to be heated. The medium may be a liquid, gas or solid material. A portion of the heat in the flue 33 is transferred to the storage tank or medium adjacent the flue wall 32.

The flue 33 has a small end 34 at the top of the flue which communicates with the atmosphere, and a large end 36 at the bottom of the flue, adjacent the burner 31. Several plates 12 are distributed somewhat evenly along tube 14. When the plates 12 are spread (FIG. 1), they extend approximately to the portion of the flue wall 32 adjacent the respective plates 12. Thus, the plates at the bottom 36 of the flue 33 are longer than the plates at the top 34. However, all of the plates 12 and bars 16 are smaller in width than the small end 34 of the flue 33, so that the baffle 10 may be removed through that end of the flue when the plates are collapsed.

The plates 12 are preferably skewed on tube 14 (FIG. 2), in such a way that all of the gases in the flue 33 are diverted by at least one of the plates 12, without completely obstructing the flow of gases through the flue.

The baffle 10 (FIG. 1) may be installed in a frusto-conical flue 33 by removing dowel 30 and sliding rod 26 downwardly within tube 14. As the pins 28 slide down in slots 24, the plates 12 collapse. Since the width of the plates 12 is less than the small end 34 of the flue 33, the baffle 10 may be easily installed in the flue through the narrow end 34.

When the baffle 10 is in the flue 33, the rod 26 may be lifted upwardly through tube 14. As the pins 28 rise up, they push the plates 12 outwardly toward flue wall 32. The plates 12 are held in place when the dowel 30 is inserted through the tube 14 and the rod 26.

Exhaust gases and heat which rise from the burner 31 through the flue 33 are diverted from at least one of the plates 12 toward flue wall 32. Gases and heat are also deflected from flue wall 32 towards the baffle 10. The turbulence created by the baffle 10 against flue wall 32 increases the heat transfer across the flue wall to the water in the storage tank.

If the baffle 10 or flue 33 must be cleaned or repaired, the baffle 10 may be easily removed from the flue 33 by removing the dowel 30 and sliding the rod 26 down. As the pins 28 descend, plates 12 collapse, and the baffle 10 may be removed through the narrow end 34 of the flue 33.

The baffle 10 may be used in any heat recuperator to transfer heat from a heat source through a flue 33 to any medium adjacent to and in thermal communication with the flue wall 32, such as the atmosphere adjacent a furnace flue or liquid or gases adjacent a chemical process heater.

The many advantages of this flue baffle are now apparent. The baffle may be installed or removed from a frusto-conical flue through the narrow end of the flue, without disassembling any parts in the bottom of the hot water heater. Also, the plates may be skewed so that all of the gases and heat which flow through the flue are obstructed by at least one of the baffle plates, without excessively obstructing the flow of gases and heat out of the flue.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. In a heating device having a storage tank, a burner beneath said storage tank and a flue passing through said storage tank for heat transfer to material in said storage tank and for escape of exhaust gases from said burner, said flue having a bottom end adjacent said burner and a top end in communication with the atmosphere, the improvement comprising: a removable flue baffle comprising diverting means in said flue for diverting the flow of gases and heat to contact the walls of said flue and means for collapsing said diverting means in said flue so that said baffle may be installed in or removed from said top end of said flue which may be smaller than said bottom end.

2. The baffle of claim 1 wherein said diverting means includes a tube in said flue and a plurality of plates secured to said tube, said plates having a width which is smaller than said top end of said flue.

3. The baffle of claim 2 wherein said collapsing means comprises:

a hinge on each of said plates;

a slot in said tube beneath each of said plates;

a slidable rod in said tube;

a plurality of pins in said rod, one of said pins extending through each of said slots;

said pins contacting said plates, spreading said plates when said rod and said pins are lifted upwardly, and allowing said plates to collapse when said rod and said pins are slid downwardly; and a dowel secured to said rod and in communication with said tube for securing said rod in a pre-determined relationship to said tube.

4. The baffle of claim 1 wherein said flue is frusto-conical and said top end is smaller than said bottom end.

5. The baffle of claim 1 wherein said plates are skewed on said tube.

6. A heating device comprising:

a storage tank;

heating means beneath said storage tank for heating said storage tank;

means in said storage tank for releasing heated gases created by said heating means from said heating means and transferring a portion of the heat in said gases to material within said storage tank, said release means having a bottom end adjacent said heating means and a top end in communication with the atmosphere;

removable diverting means in said releasing means for diverting the flow of said heated gases and heat to contact the walls of said release means; and means for collapsing said diverting means in said release means so that said diverting means may be installed in or removed from said top end of said release means which may be smaller than said bottom end.

7. The heating device of claim 6 wherein said heating means comprises a burning means and said release means comprises a flue through said storage tank.

8. The heating device of claim 7 wherein said diverting means comprises a tube in said flue and a plurality of plates secured to said tube, said plates having a width which is smaller than said top end of said flue.

9. The heating device of claim 8 wherein said collapsing means comprises:

a hinge on each of said plates;

a slot in said tube beneath each of said plates;

a slidable rod in said tube;

a plurality of pins in said rod, one of said pins extending through each of said slots;

said pins contacting said plates, spreading said plates when said rod and said pins are lifted upwardly, and allowing said plates to collapse when said rod and said pins are slid downwardly; and a dowel secured to said rod and in communication with said tube for securing said rod in a pre-determined relationship to said tube.

10. The heating device of claim 7 wherein said flue is frusto-conical, and said top end is more narrow than said bottom end.

11. The heating device of claim 8 wherein said plates are skewed on said tube.

12. The heating device of claim 6 wherein said material comprises liquid.

13. The heating device of claim 12 wherein said liquid comprises water.

14. A heat recuperator comprising:

a heat source;

a medium to be heated in spaced relation with said heat source;

heat transfer means adjacent said heat source and in thermal communication with said medium for transferring a portion of the heat from said heat source to said medium, said heat transfer means having a bottom end adjacent said heat source and an open top end;

removable diverting means in said heat transfer means for diverting the flow of heat from said heat source to contact the walls of said heat transfer means; and means for collapsing said diverting means in said heat transfer means so that said diverting means may be installed in or removed from said top end of said heat transfer means which may be smaller than said bottom end.

15. The recuperator of claim 14 wherein said heat source comprises a burning means and said heat transfer means comprises a flue.

16. The recuperator of claim 15 wherein said diverting means comprises a tube in said flue and a plurality of plates secured to said tube, said plates having a width which is smaller than said top end of said flue.

17. The recuperator of claim 16 wherein said collapsing means comprises:

a hinge on each of said plates;

a slot in said tube beneath each of said plates;

a slidable rod in said tube;

a plurality of pins in said rod, one of said pins extending through each of said slots;

said pins contacting said plates, spreading said plates when said rod and said pins are lifted upwardly, and allowing said plates to collapse when said rod and said pins are slid downwardly; and a dowel secured to said rod and in communication with said tube for securing said rod in a predetermined relationship to said tube.

18. The recuperator of claim 15 wherein said flue is frusto-conical, and said top end is more narrow than said bottom end.

19. The recuperator of claim 16 wherein said plates are skewed on said tube.

20. The recuperator of claim 14 wherein said medium comprises a liquid.

21. The recuperator of claim 14 wherein said medium comprises a gas.

22. The recuperator of claim 14 wherein said medium comprises a solid.

23. The heating device of claim 6 wherein said material comprises gas.

24. The heating device of claim 6 wherein said material comprises solids.

* * * * *